United States Patent [19]

Anderson

[11] 4,092,799

[45] June 6, 1978

[54] TETHERED EXERCISE DEVICE

[76] Inventor: Paul R. Anderson, 23701 Surf Cove, Laguna Niguel, Calif. 92677

[21] Appl. No.: 675,920

[22] Filed: Apr. 12, 1976

[51] Int. Cl.[2] ..... A63H 33/18

[52] U.S. Cl. ..... 46/52; 273/95 A; 272/117

[58] Field of Search ..... 46/47, 51, 52; 273/58 C, 95 A; 272/117

[56] References Cited

U.S. PATENT DOCUMENTS

| | | | |
|---|---|---|---|
| 2,051,366 | 8/1936 | Catron | 46/51 |
| 2,096,121 | 10/1937 | Manelia | 46/52 |
| 2,226,246 | 12/1940 | Kloepping | 273/58 C |
| 2,307,905 | 1/1943 | Ament | 46/52 |
| 2,979,858 | 4/1961 | Holman, Jr. | 46/52 |
| 3,046,692 | 7/1962 | Steiner | 46/52 |
| 3,630,521 | 12/1971 | Lingbeek | 273/26 EA |

*Primary Examiner*—Louis G. Mancene
*Assistant Examiner*—Robert F. Cutting
*Attorney, Agent, or Firm*—William I. Beach

[57] ABSTRACT

A tethered exercise device for developing muscle tone and coordination in the wrist, arm and shoulder. The device has a handle connected by swivel means to an elongate strap. A ball is mounted on the strap by threading an end portion of the strap through a plurality of displaced slit openings in the wall of the ball for reciprocal movement thereon and adapted to be whirled about at any position on the strap.

2 Claims, 2 Drawing Figures

TETHERED EXERCISE DEVICE

BACKGROUND OF THE INVENTION

1. Field of the Invention

The present invention relates to exercising devices and more particularly to tethered devices for improving muscle coordination and tone in the wrist, arm and shoulder muscles.

2. Description of the Prior Art

Athletes undertake various forms of exercise and calisthenics in order to condition their bodies for greater perfection and skill so as to excel in a selected sporting event. In training for contact sport where hard, cord-like muscles are important the athlete tends to build up his muscles with heavy weights and other forms of strenuous exercises. On the other hand, in non-contact sports such as tennis, golf and the like where supple muscles are more suited for coordination and rhythmic motion workout with ligher weights are preferable.

When playing tennis the player often develops a painful arm condition known as "tennis elbow". The primary muscle in the front of the arm is defined as a biceps muscle and its function is to exert a pull so as to bend the elbow. The muscle in the back of the arm defined as the triceps muscle functions to return the bent elbow to a straight position. These muscles are subject to bruises and strains if they are not conditioned with proper exercises.

Therefore, it is the object of the present invention to provide a tethered exercise device that will properly condition muscles subject to strains and stresses and yet which can be readily manufactured with simple but unique means for exercising muscles in the wrist, arm and shoulder.

SUMMARY OF THE INVENTION

In carrying out the principles of the present invention in accordance with a preferred embodiment thereof, a tethered exercise device includes an elongate resilient strap which has a closed loop end. A ball is mounted on the strap for reciprocal movement thereon. The ball being of resilient material has a flexible wall and a hollow core. The wall has a first opening in a sidewall, a second and third opening in a top wall and a fourth opening substantially opposite of the first opening. The openings are adapted to receive the strap therethrough. Included is a handle which has a pin fastened thereto. Also included is a U-shaped hook which has an open end leg and a second longer leg, the longer leg further has a closed end loop formed on the lower end. The closed end loop is rotatably mounted on the pin and the closed loop end of the strap is mounted on the longer leg of the U-shaped hook.

DETAILED DESCRIPTION

Figure 1:
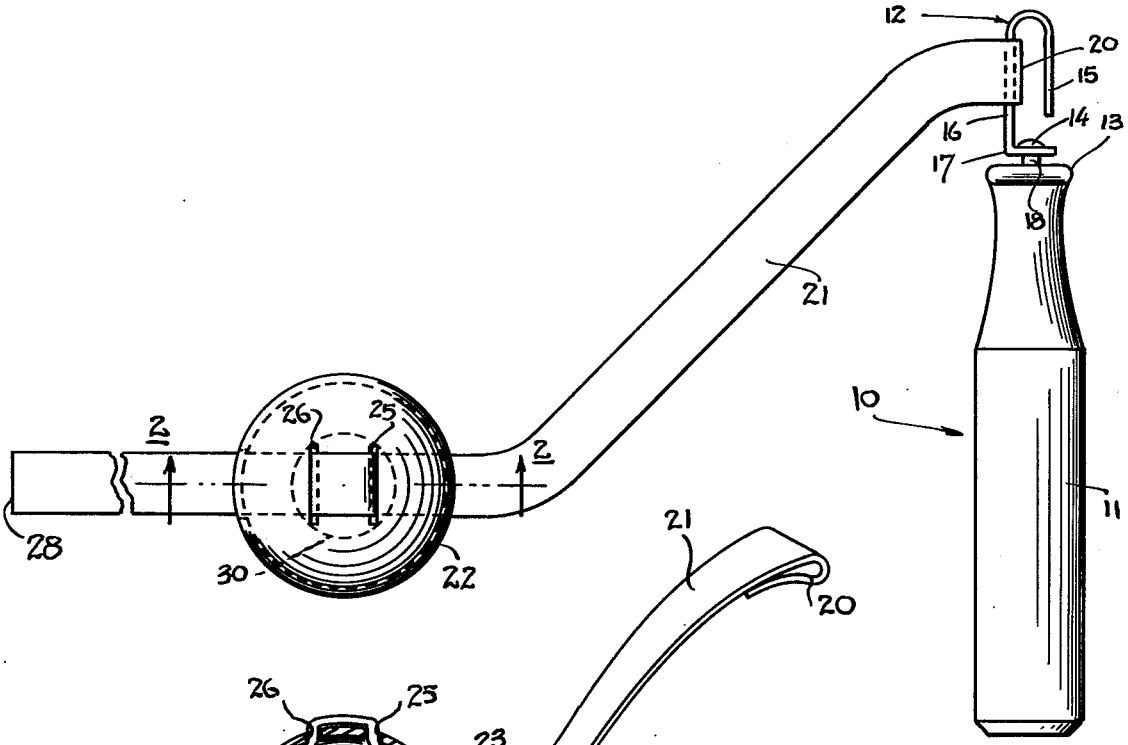
FIG. 1 is a side elevation view of the tethered exercise device embodying the present invention.

Referring to FIG. 1, it can be seen that the tethered exercise device 10 includes a handle 11. Connected to handle 11 is a swivel 12 rotatably fastened to end 13 by pin 14. Swivel 12 consists of a U-shaped hook which has an open end leg 15 and a longer closed end leg 16. At the lower end of leg 16 is formed a loop 17 in a plane normal to the central longitudinal axis of leg 16. The inner diameter of loop 17 is larger than the diameter of shank 19 of pin 14 so that swivel 12 can rotate freely on end 13 of handle 11.

Wrapped loosely around leg 16 is another loop 20 formed on one end of strap 21 which has a length of about 18 inches and has a cross-sectional area of ⅝inches wise by 1/16 inches thick. Obviously, strap 21 can have other lengths and cross-sectional areas and still function as an exercise device but after making many tests the above mentioned dimensions are preferable. Further, strap 21 is preferably constructed of rubber or a good substitute material possessing an elastic yield of approximately 9/64 of an inch per lineal inch of length under a tensile load of 16 ounces.

Mounted on strap 21 is a ball 22. Again a ball of various diameters can be used but for purposes and functions to be discussed later a ball having the size and resiliency of a tennis ball is best suited for mounting on strap 21. Inasmuch as ball 22 is designed to be moved from one position to another on strap 21 for providing variation in the form of exercising, a tennis ball has the flexibility required to hold it steadfastly in position on the strap when whirled about at high rotational speed. In that connection, the means for mounting ball 22 on strap 21 consists of slitting wall 23 of the ball in four spaced apart locations. For example, a slit or opening 24 substantially larger than the width of strap 21 is cut in wall 23 on one side of ball 22. Similar openings 25 and 26, spaced apart about six times the thickness of strap 21, are cut in the top wall of ball 22. The fourth and last opening 27 is cut in the side wall 23 opposite of opening 24. Then a flat curved shaped needle is attached to end 28 of strap 21 and inserted inwardly through side opening 24 so as to turn the tip upwardly and outwardly of opening 25. To thread strap 21 through openings 24 and 25 ball 22 is squeezed in such a manner that the pressure separates the lips of the openings to allow strap 21 to be pulled easily through the openings. The process of threading is continued in a like manner through openings 26 and 27 whereupon ball 22 is completely mounted on strap 21.

Figure 3:
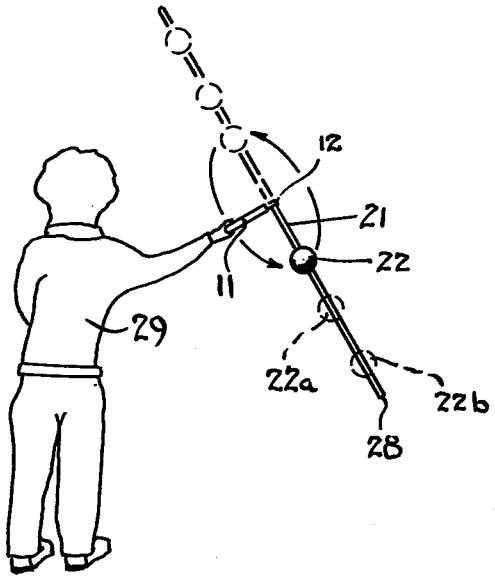
FIG. 3 is a perspective view of the tethered exercise device in operation.

In operating the present invention reference is made to FIG. 3 which shows operator 29 whirling ball 22 in a circular path about his hand. Ball 22 is mounted on strap 21 about one-third of the distance from swivel 12 on handle 11 to the end 28 of the strap. The space between ball 22 and swivel 12 is the radius of the rotational center of the whirling ball 22. Located below ball 22 is ball 22*a* and ball 22*b* which represents ball 22 moved to radius *a* and radius *b* respectively on strap 21. To move ball 22 to radius *a*, for example, the ball is held in one hand and squeezed thereby separating the lips of openings 27 and 26 so that strap 21 is relatively loose in said openings. Then with the other hand the portion of the strap laying externally between openings 25 and 26 is pulled outwardly so as to withdraw the portion of strap threaded through openings 27 and 26 into as much a loop as required to move ball 22 in the direction of end 28 of the strap. Following this ball 22 is again squeezed so that the lips of openings 25 and 24 are separated whereupon the loose portion of the strap in the loop is pulled therethrough which advances ball 22 in the direction of end 28 of strap 21. The importance of changing the position of ball 22 on the strap so that the radius of the rotational path of the ball can be changed is discussed below.

When revolving in a circle ball 22 exerts a force, defined as centrifugal force, away from the center of rotation, in this case the hand of operator 29. This force is a reactive force directed along strap 21 and the magnitude of this force is proportional to the weight of the ball multiplied by the velocity or rotational speed squared and divided by the lineal distance or radius of the ball to the center of rotation. When the operator doubles the number of revovutions per minute the force on the ball will be increased by a factor of 4; increasing the speed by 10 will increase the force by 100. This assumes that the radius to the center of rotation remains constant.

The subject invention provides unique means for varying the radius of the ball while whirling it in a circle by virtue of the elastic property of strap 21. When the operator whirls ball 22 at a rotational speed to impart to it a centrifugal force sufficient to overcome the elastic yield of the strap the strap will stretch and the radius to the ball will be increased by an incremental amount. When this takes place the increased radius tends to reduce the centrifugal force and strap 21 will gradually retract to its original length unless the operator increased the rotational speed to maintain the increased radius and the enlarged circle of rotation. Subsequently, the operator can stretch out the ball in a steadily increasing diameter circle depending upon the amount of effort he puts into increasing the speed of rotation.

Similarly, a new set of exercising conditions is provided each time ball 22 is moved further along the length of strap 21 or, in effect, by increasing the radius of the ball. Moving ball 22 to position 22*a* increases the radius from the center of rotation to the ball. Since the radius is now longer it follows that the diameter of the circle of rotation will be larger than the circle of the prior case. The speed of rotation will necessarily have to be increased more than before the stretch strap 21 so as to steadily enlarge the circle of rotation.

Figure 2:
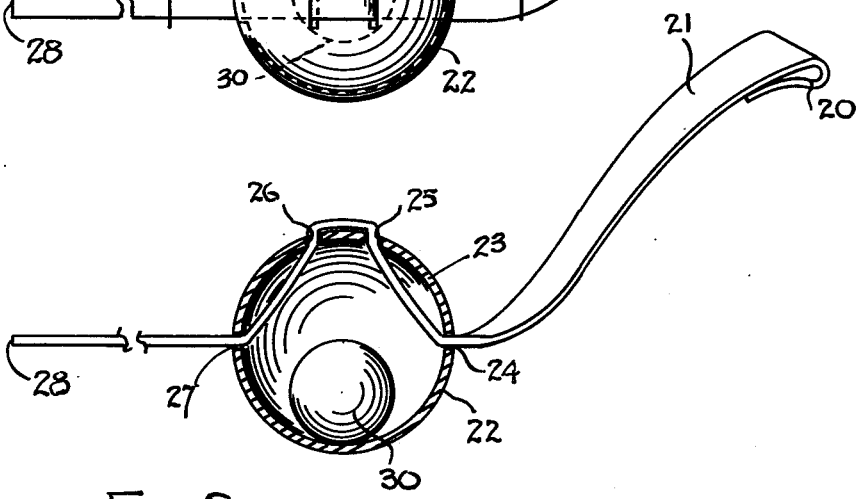
FIG. 2 is a partial cross-sectional view of the tethered exercise device taken along line 2—2 shown in FIG. 1.

The above described conditions can be altered again by changing the weight of ball 22. Referring to FIG. 2 it is seen that a steel ball is disposed inside of ball 22. This is achieved by inserting the steel ball 30 through opening 24 prior to threading strap 21 through openings 24, 25, 26 and 27 of ball 22. With a heavier weighted ball it required less effort to put in the rotational speed in order to stretch out the radius of strap 21. The weight of ball 22 can be increased even further if desired by inserting more but smaller steel balls inside of ball 22.

From the description and illustration of the present invention it is obvious that it provides many important advantages which can be used effectively and efficiently as a tethered exercise device for strengthening and improving muscular coordination and rythm of the wrist, arm and shoulder.

The foregoing description is to be clearly understood to be given by way of illustration and example only, the spirit and scope of the present invention being limited solely by the appended claims.

I claim:

1. A tethered exercise device which comprises:

an elongate resilient strap having a closed loop end, a ball mounted on the strap for reciprocal movement thereon, the ball being of resilient material and having a flexible wall and hollow core, the wall having a first opening in a side wall, a second and third opening in a top wall and a fourth opening substantially opposite the first opening, said openings being adapted to receive said strap therethrough, a handle, a pin fastened to the handle, and a U-shaped hook having an open end leg and a second longer leg, the longer leg further having a closed end loop formed on the lower end thereof, the loop being rotatably mounted on the pin, and the closed loop end of said strap being mounted on said longer leg of the U-shaped hook.

2. An exercise device as recited in claim 1, further including: a weighted element disposed in the hollow core of said ball.

* * * * *